US006898924B1

(12) United States Patent
McCoy

(10) Patent No.: US 6,898,924 B1
(45) Date of Patent: May 31, 2005

(54) SAFETY RELEASE ATTACHMENT FOR STIRRUP

(76) Inventor: Michael J. McCoy, 2629 Red Bridge Rd., Laurel, MT (US) 59004

( * ) Notice: Subject to any disclaimer, the term of this patent is extended or adjusted under 35 U.S.C. 154(b) by 0 days.

(21) Appl. No.: 10/721,676

(22) Filed: Nov. 26, 2003

(51) Int. Cl.[7] ..... B68C 3/00
(52) U.S. Cl. ..... 54/49
(58) Field of Search ..... 54/47, 49, 48; D30/142

(56) References Cited

U.S. PATENT DOCUMENTS 1,087,762 A * 2/1914 Harms ..... 54/49
3,157,977 A * 11/1964 Kitchingham, Jr. ..... 54/49
4,209,962 A * 7/1980 Forest ..... 54/49
4,680,921 A * 7/1987 Bezin ..... 54/49
4,869,053 A 9/1989 Bradford et al.
4,969,316 A * 11/1990 Brown ..... 54/49
4,995,226 A * 2/1991 Kuhn, Jr. ..... 54/49
5,058,366 A 10/1991 McCoy

* cited by examiner

*Primary Examiner*—Teri Pham Luu
*Assistant Examiner*—Elizabeth Shaw

(57) ABSTRACT

In a quick release safety attachment for a stirrup comprising spring-loaded rods in a sleeve which rests in the stirrup strap with the ends of the rods engaging the ends of a stirrup and a pair of lever arms extending radially outward from the interior of the sleeve engaged with the rods for controlling the operation of the device to release the stirrup, the arms are provided with notches and a Velcro strap for more positively securing the arms in place when the safety release is cocked and bearings are provided in the sleeve to work in conjunction with the rods to provide a more positive release and minimize the possibility of a premature release.

1 Claim, 3 Drawing Sheets

SAFETY RELEASE ATTACHMENT FOR STIRRUP

FIELD OF THE INVENTION

This invention is for use with a stirrup of a horse-riding saddle to provide a mechanism for quick releasing the stirrup from its attachment to the saddle in the event the rider's foot is caught in the stirrup to prevent the rider from being dragged by the horse if the horse bolts.

DESCRIPTION OF THE PRIOR ART

The closest and most pertinent prior art is shown in U.S. Pat. No. 5,058,366 by McCoy dated Oct. 22, 1991 titled "SAFETY RELEASE ATTACHMENT FOR STIRRUP" and an earlier U.S. Pat. No. 4,869,053 dated Sep. 26, 1989 by Bradford and McCoy titled "QUICK RELEASE SAFETY ATTACHMENT FOR A STIRRUP".

Both of the above patents describe in some detail the purpose and the function of the quick release safety attachment and the manner in which the device operates to protect the rider against the danger described above. For that purpose, the description of the prior art in both of those aforementioned patents is incorporated herein by reference.

SUMMARY OF THE INVENTION

The present invention is an improvement and variation of the quick release safety attachment for a stirrup as described and illustrated in U.S. Pat. No. 4,869,053 and therefore the description contained in the summary of the invention as contained in the '053 patent is incorporated herein by reference for descriptive purposes. As stated therein, the device comprises a hollow cylinder sleeve containing spring-loaded rods which extend out the ends of the cylinder to engage the open ends of the stirrup. A pair of lever arms extend radially out from the cylinder for cocking or priming the release mechanism and for controlling the device for disengaging the ends of the rod from the ends of the stirrup to release the stirrup when necessary. An improvement of the invention includes annular thin washer-like bearings within the sleeve or cylinder on each side of the spacers or bushings to eliminate gouging of the spacers or bushings in the cylinder. This has produced a more positive and reliable release of the safety mechanism. In addition the lever arms are provided with notches at their upper ends for engagement to help ensure that the arms stay together in the cocked or primed position. Further, a strap made out of some suitable textile material with Velcro fasteners is provided to wrap around the arms to further ensure that the lever arms will not prematurely trip or release the mechanism. In addition the strap acts as padding for the comfort of the rider. Additionally, the lever arms are modified with a curvature for the comfort of the rider to minimize rubbing of the lever arms against the legs of the rider. Also, the curvature of the lever arms appears to have increased the rotational angle for release to further add to the reliability.

DESCRIPTION OF THE PREFERRED EMBODIMENT

Figure 1:
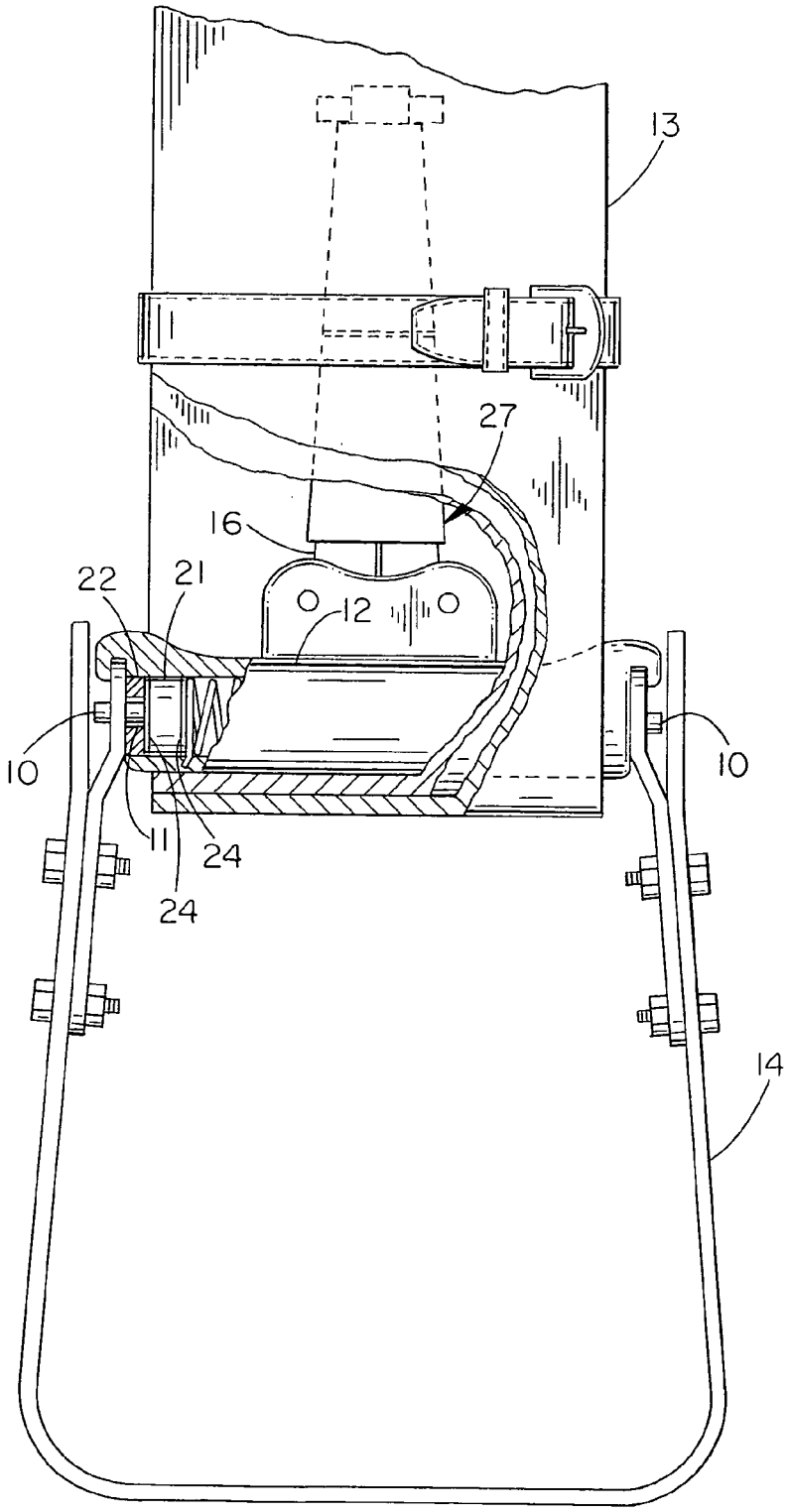
FIG. 1 is a partial breakaway illustration of the quick release mechanism incorporating the instant invention in place for holding a stirrup attached to the stirrup strap.

U.S. Pat. No. 4,869,053 describes in detail the construction, function and operation of a quick release safety attachment and how it is coupled to the rider's saddle and how it functions to release the stirrup in the event of an emergency such as where the rider's foot is caught in the stirrup and the horse bolts. For that purpose, the description contained in the '053 patent is incorporated herein by reference.

As described in greater detail in the aforementioned '053 patent, the keyed ends 10 of a pair of spring-loaded bolts 11 inside a cylinder 12 which rests in the closed loop of a stirrup strap 13 engages openings at the open end of a stirrup 14 to hold the stirrup in place to accommodate the rider's foot during normal use. A pair of elongated lever arms 16 are pivotally attached to the outer shell or case of cylinder 12 and extend radially outward from cylinder 12 into the space between the two sides or rungs of stirrup strap 13. The springs within the cylinder 12 act against their respective bolts 11 to bias the bolts to move axially inward to disengage their ends from the stirrup apertures but the lower ends 17 of lever arms 16 act on the heads of the bolts 11 against the force of the springs to keep the outer ends of the bolts engaged with the stirrup apertures to hold the stirrup in place thereby priming or cocking the release mechanism. In certain emergencies such as if the rider is dismounted but has a foot in the stirrup and the horse should bolt or if the rider should get thrown from the horse with a foot caught in the stirrup, the stirrup will swing in an arc about the axis of the cylinder 12, causing the bolts 11 to rotate so that the caps or heads 18 of the bolts 11 are turned so that the inner teeth 17 of arms 16 reach a gap or slot or cutout 19 so that the lever arms are no longer applying axial force against the force of the spring and the spring takes over and pulls the bolts axially inward to release the ends of the bolts 10 from the apertures at the end of the stirrup 14 so that the stirrup will fall free.

Figure 2:
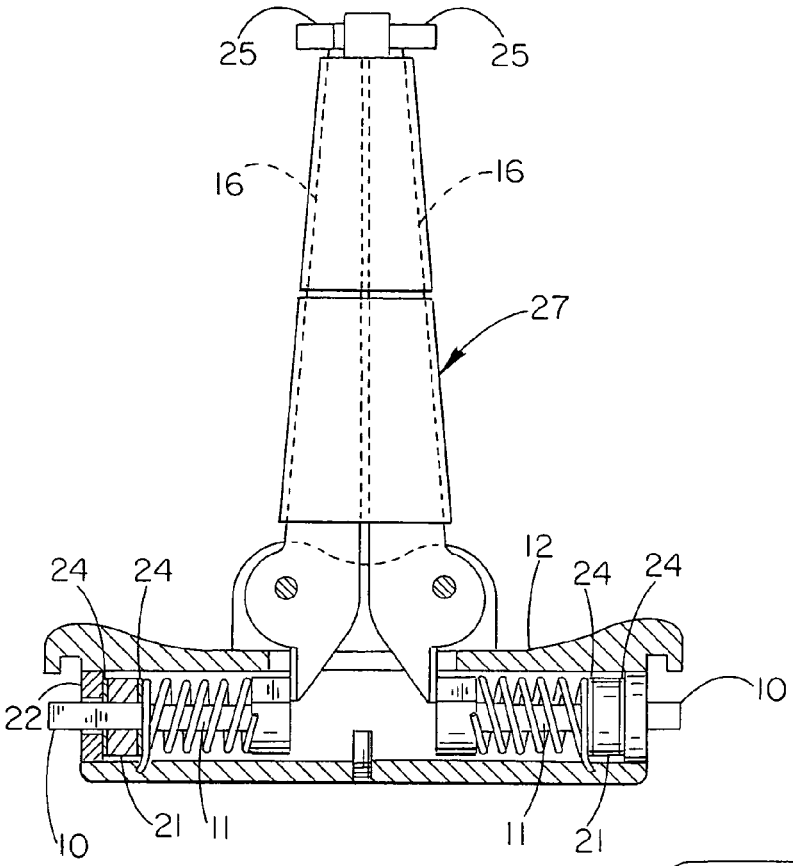
FIG. 2 is a sectioned view of the quick release mechanism primed or cocked for holding the stirrup in place.
Figure 3:
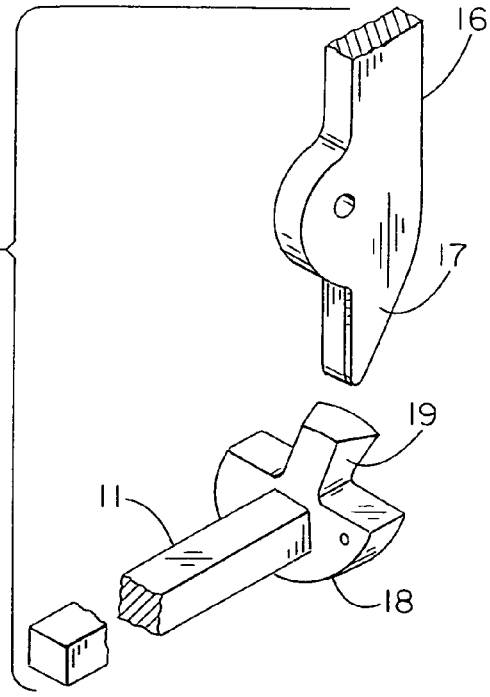
FIG. 3 is an exploded diagrammatic illustration of a portion of the holding and release mechanism.
Figure 4:
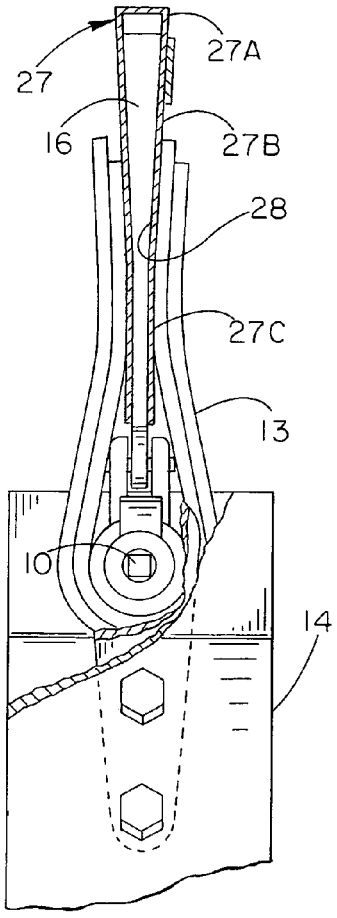
FIG. 4 is a partial breakaway and sectioned end or side view of FIG. 2.
Figure 5:
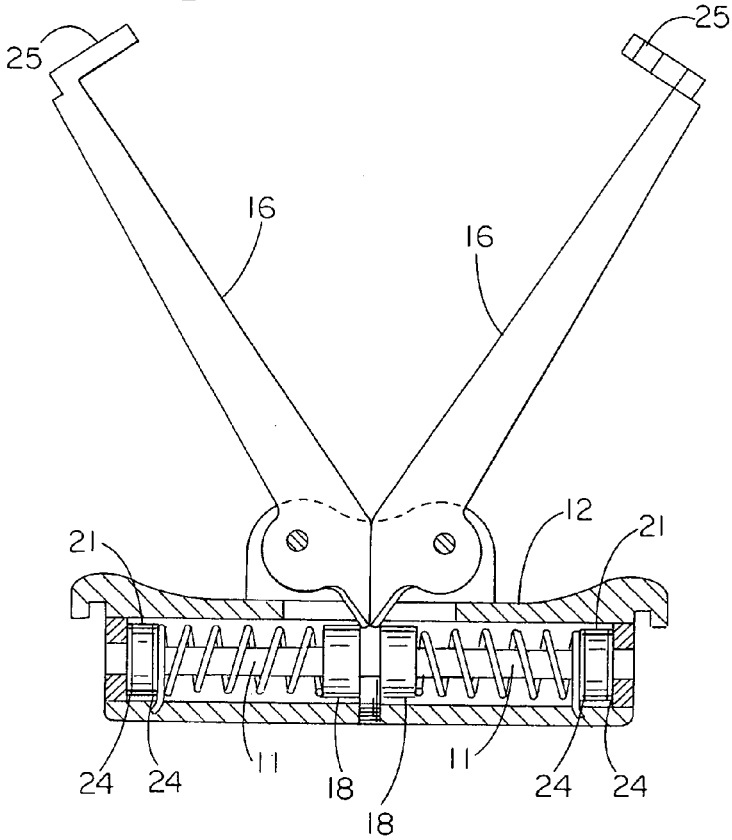
FIG. 5 is similar to FIG. 2 illustrating the quick release mechanism in the uncocked or unprimed condition.
Figure 6:
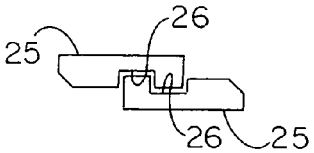
FIG. 6 illustrates the notched ends of the trigger arms.

It has been found that the spring acting against the spacers or bushings 21 on one side and the friction between the spacers or bushings 21 against shoulders 22 may gouge the sides of the spacers or bushings to cause inconsistencies in the release of the mechanism, namely, premature triggering. A pair of thin, washer-like annular bearings 24 are placed on each side of the bushings 21 to provide a more positive release and to make the triggering or release of the safety mechanism more reliable. To further enhance the reliability and accuracy of the release mechanism the upper ends of lever arms 16 are provided with extensions 25 with notches 26 formed in said extensions. The notches and the extensions are dimensioned such that when the arms are brought together, as best seen in FIG. 2, the extensions are releasably locked together by the engagement of the notches to ensure against a release of the lever arms from the cocked or primed condition during normal use. As a further protective feature, arms 16 in the primed or cocked position are wrapped around with a strap 27 preferably having releasable Velcro fasteners. Yet a further feature is a curvature shown at 28 on lever arms 16 to minimize discomfort of the arms rubbing against the leg of the rider. The textile style wrapping strap 27 also lessens discomfort to the rider's leg.

Figure 7:
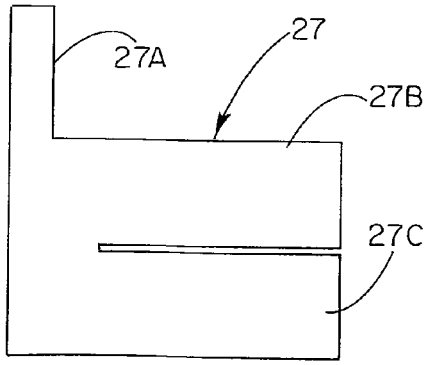
FIG. 7 is a plan view of a wrap-around strap for releasably holding the arms in the primed condition.

The plan view of strap 27 is shown in FIG. 7. The narrow upward extending strap 27A is first folded over the top of lever arms 16 in the cocked or primed condition. The wider horizontal straps 27B and 27C are then wrapped around the lever arms to help secure the arms in the primed condition.

I claim:

1. In a quick release safety attachment for a stirrup having spring-loaded rods and annular bushings for the rods in a sleeve, said safety attachment resting in a stirrup strap for releasably engaging the ends of a stirrup from the ends of the rods and a pair of lever arms extending radially outward from the sleeve having inner ends engaging the rods for controlling the disengagement of the rods from the ends of the stirrup, the improvement comprising:

an annular thin washer-like bearing within the sleeve adjacent each bushing, with an end of each spring in the sleeve pressing up against its associated bearing, said rods movably extending through the annular openings in the respective bearings for engagement with the stirrup.

* * * * *

UNITED STATES PATENT AND TRADEMARK OFFICE

CERTIFICATE OF CORRECTION

PATENT NO. : 6,898,924 B1
DATED : May 31, 2005
INVENTOR(S) : Michael J. McCoy

It is certified that error appears in the above-identified patent and that said Letters Patent is hereby corrected as shown below:

Column 4,
Line 11, after "stirrup;" insert
-- notches at the outer ends of said arms for engagement with one another for releasably securing said arms together;
a strap for releasably wrapping around said arms with the notches engaged;
said arms having a curvature adapted to generally conform to the curvature of the leg of the rider. --.

Signed and Sealed this

Sixteenth Day of August, 2005

JON W. DUDAS
*Director of the United States Patent and Trademark Office*